US010638553B2

(12) United States Patent
Minen et al.

(10) Patent No.: US 10,638,553 B2
(45) Date of Patent: Apr. 28, 2020

(54) TRANSVERSE FLUX INDUCTION HEATING APPARATUS

(71) Applicant: Danieli & C. Officine Meccaniche S.P.A., Buttrio (IT)

(72) Inventors: Michele Minen, Udine (IT); Fabio Guastini, Dolegna Del Collio (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 314 days.

(21) Appl. No.: 15/740,136

(22) PCT Filed: Jun. 29, 2016

(86) PCT No.: PCT/IB2016/053876
§ 371 (c)(1),
(2) Date: Dec. 27, 2017

(87) PCT Pub. No.: WO2017/002025
PCT Pub. Date: Jan. 5, 2017

(65) Prior Publication Data

US 2018/0317285 A1 Nov. 1, 2018

(30) Foreign Application Priority Data

Jun. 30, 2015 (IT) ..... 102015000029165

(51) Int. Cl.
*H05B 6/10* (2006.01)
*H05B 6/36* (2006.01)

(52) U.S. Cl.
CPC ..... *H05B 6/104* (2013.01); *H05B 6/365* (2013.01)

(58) Field of Classification Search
CPC ..... H05B 6/104; H05B 6/365
(Continued)

(56) References Cited

U.S. PATENT DOCUMENTS 5,739,506 A 4/1998 Hanton et al.
2002/0148830 A1 10/2002 Ross
(Continued)

FOREIGN PATENT DOCUMENTS

JP 07169561 7/1995
KR 100283160 3/2001
WO WO2015094482 A1 6/2015

*Primary Examiner* — Christine J Skubinna
(74) *Attorney, Agent, or Firm* — Stetina Brunda Garred and Brucker

(57) ABSTRACT

A transverse flux induction heating apparatus (1, 100), defining a first longitudinal axis (X, R), for heating a metallic strip (11), the apparatus comprises at least two induction coils (2, 4; 102, 104) arranged on respective planes parallel to each other and parallel to said first longitudinal axis, and mutually arranged at a distance such to allow the passage of the strip between said at least two induction coils along a second longitudinal axis (Y, S) perpendicular to said first longitudinal axis; at least two compensation poles (20, 22, 24, 26; 120, 124), each compensation pole being constrained to a respective induction coil; wherein each compensation pole comprises a winding (28, 128), having at least one turn (29, 129), and a first auxiliary magnetic flux concentrator (30, 130) surrounded by the at least one turn; wherein at least one of said at least two compensator poles is adapted to move along the first longitudinal axis.

15 Claims, 7 Drawing Sheets

(58) Field of Classification Search
USPC ..... 219/645
See application file for complete search history.

(56) References Cited

U.S. PATENT DOCUMENTS

2007/0235446 A1 10/2007 Maochang et al.
2017/0167792 A1* 6/2017 Mordeglia ..... C21C 5/5252

* cited by examiner

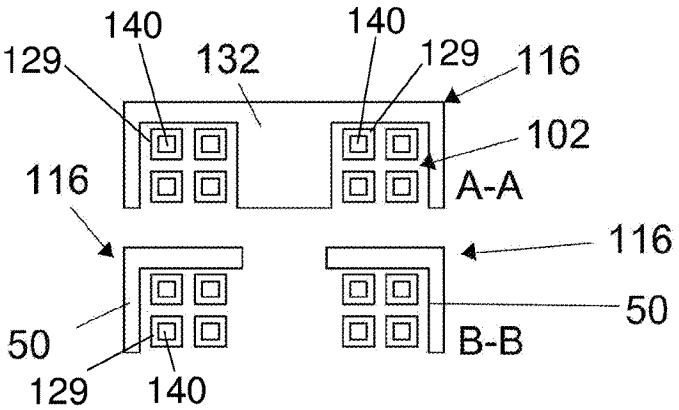
Fig. 10a
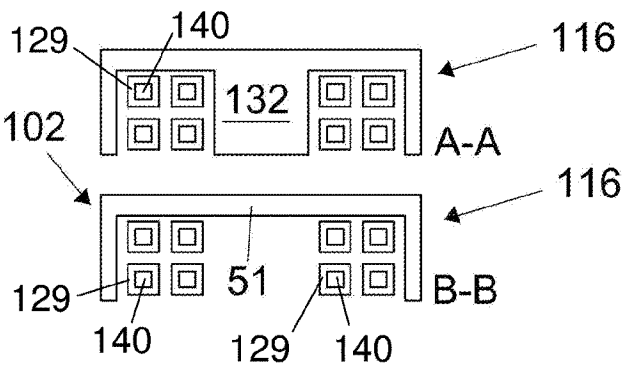
Fig. 10b
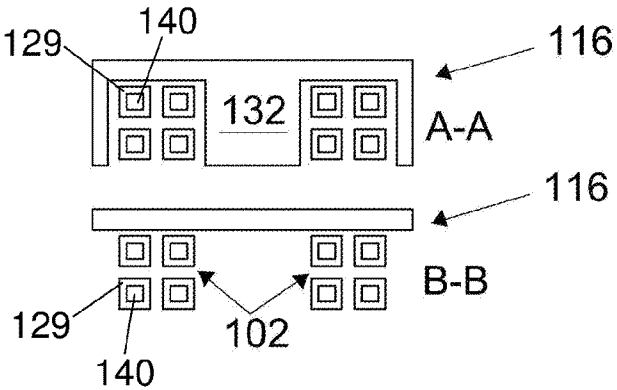
Fig. 10c
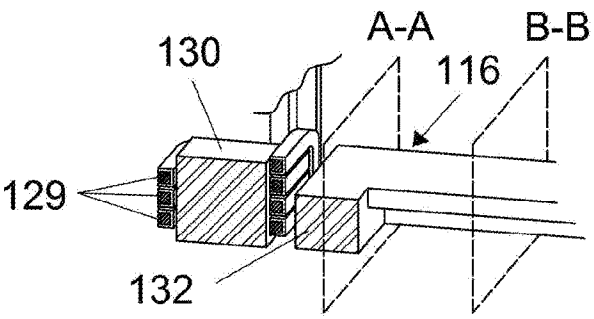
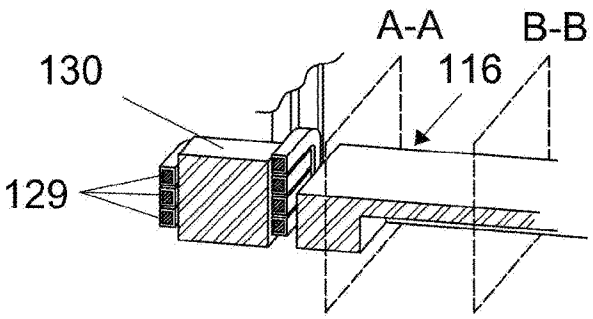
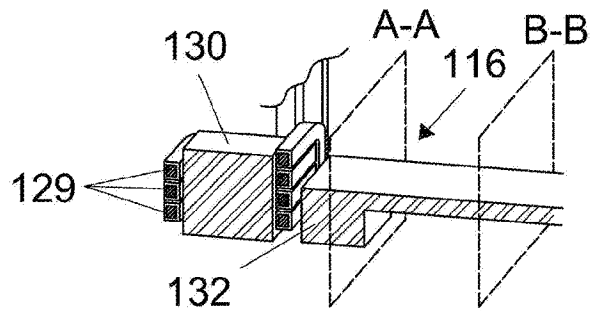

TRANSVERSE FLUX INDUCTION HEATING APPARATUS

CROSS REFERENCE TO RELATED APPLICATION(S)

The present application claims priority to PCT International Application No. PCT/IB2016/053876 filed on Jun. 29, 2016, which application claims priority to Italian Patent Application No. 102015000029165 filed Jun. 30, 2015, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a transverse flux induction heating apparatus for heating a metallic strip.

BACKGROUND ART

Induction heating is used in heating processes of metallic material strips or sheets. This type of heating envisages that some inductors, crossed by current, generate a magnetic field which induces currents in the metal, which is heated by Joule effect. In order to heat strips made of electrically conductive material a type of induction heating named "transverse flux", may be used, in which the magnetic field produced by the inductors is mainly perpendicular to the surface of the strip itself. Typically, turn-shaped inductors, mutually arranged on two planes parallel to the upper and lower faces of the strip which is advanced, are envisaged. The conductors of the inductors facing the strip are crossed by a current, typically alternating and of the same phase, provided by a power supply unit.

The magnetic field thus generated entirely crosses the thickness of the strip, providing that the frequency of the alternating current which crosses the conductors is sufficiently low. Indeed, as the frequency increases, the currents induced on the strip will produce increasingly greater reaction fluxes, opposite to the main flux, as long as a separation of the fluxes produced on the two faces of the strip is obtained. The flux separation may be obtained at increasingly low frequencies, the greater is the thickness of the strip. In practice, the strip itself works as an electromagnetic screen.

The transverse flux induction heating apparatus makes it possible to obtain good efficiency in terms of power delivered by the power supply unit in relation to the power transferred to the strip. With respect to longitudinal flux induction heating, a transverse flux induction heating apparatus is more efficient and, being open on the side opposite to the supply of the turns, improves maintainability because it allows the strip to be extracted in case of failure. However, although advantageous from certain points of view, the technology available today for transverse flux induction heating has some disadvantages.

In particular, for the strips of a given extension, in relation to the size of the corresponding inductors, the heating along the length of the strip from one side edge of the opposite one is not homogenous. Indeed, it occurs that each side edge is heated excessively, or in all cases in non-controlled manner, and that a zone adjacent to it remains colder. In particular, the magnetic field density, and thus the power density, is higher at each edge and then drastically decreases in the zone adjacent to it and increases again, in the central zone of the strip, to the desired value to obtain the heating. Such a behavior is illustrated in FIG. 6, which shows the power density pattern, expressed in W/m, as a function of the width of the strip, expressed in meters, which is obtained with the transverse flux induction heating devices of known type. The zones in which the power density is lower can be referred to as "power gaps". This effect is due to the fact that the current runs parallel to the plane of the turns of the inductor, following the path thereof, on the strip (the sense of the induced current is opposite to that of the turn). When the turns extend beyond the width of the strip, the induced current is forced to bend on its edge. This produces a greater heating of the edge, because the induced current, as the magnetic field, will be concentrated in a space defined by the so-called "penetration thickness", which is as a function of frequency. The "power gap" is created in the zone in which the induced current bends because it tends to be dispersed, thinning out in an area which is about 3-4 times the "penetration thickness".

There is a direct ratio binding the maximum power peak on the edge and the power gap. According to the known art, a method for reducing the power gap is to increase the supply frequency. This however worsens the problem of excessive heating at the edges.

It is often useful for the edges to be heated more than the center, considering that the edges tend to be colder when the strip is introduced into the induction heating apparatus. However, a controlled heating of the edges of the strip cannot be obtained with the known technology.

A further disadvantage of the currently available transverse flux induction heating devices concerns their poor flexibility for heating strips of different width. Indeed, the configuration of the heating apparatus must be adapted to obtain the optimal temperature profile for a given width of the strip, requiring complicated and costly changes in order to heat strips of different width.

US 2007/0235446A1 describes an induction device built so that each induction coil is shaped to cross the passage plane of the strip with a respective end. The configuration is such that the whole of the two induction coils entirely encloses the passage zone of the strip, thus also enclosing the zones near the passage of the edges of the strip. However, such a solution does not appear satisfactory to solve the aforesaid problems. Furthermore, it requires an excessively complex turn geometry.

The need is thus felt for a transverse flux induction heating apparatus capable of minimizing the power gaps, which makes it possible to obtain a lower, more controllable heating at the edges of the strip and which can be easily adapted to the width of the strip to be heated.

SUMMARY OF THE INVENTION

It is an object of the present invention to provide a transverse flux induction heating apparatus for heating metallic material strips or sheets which makes it possible to obtain a more uniform temperature profile along the width of the strip with respect to the prior art, and in particular to provide an apparatus which makes it possible to either minimize or cancel the power density gaps, and the consequent undesired cooling which occurs near the edges of the strip.

It is another object of the present invention to provide a transverse flux induction heating apparatus which makes it possible to have a heating of the edges of the strip which is more controlled and lower than the prior art.

It is another object of the present invention to provide a transverse flux induction heating apparatus which can be adapted easily and effectively to the width of the strip to be heated with respect to the prior art.

The present invention thus achieves the objects discussed above by providing a transverse flux induction heating apparatus defining a first longitudinal axis which according to claim 1, comprises at least two induction coils arranged on respective planes parallel to each other and parallel to said first longitudinal axis, and mutually arranged at a distance such to allow the passage of the strip between said at least two induction coils along a second longitudinal axis perpendicular to said first longitudinal axis, at least two compensation poles, each compensation pole being constrained to a respective induction coil, wherein each compensation pole comprises a winding having at least one turn and a first auxiliary magnetic flux concentrator surrounded by the at least one turn of the winding, and wherein at least one of said at least two compensation poles is adapted to move along a direction parallel to the first longitudinal axis.

In a first variant of the invention, the compensation poles are moveable along the first longitudinal axis while the induction coils are fixed.

In a second variant of the invention, instead, the compensation poles are integrally fixed to one or more of the respective induction coils; the induction coils being moveable along the first longitudinal axis.

Advantageously, both the variants of the invention, by means of a particular arrangement of the induction coils and of the compensation poles, can simplify the apparatus making maintenance easier and temperature distribution on the strip surface more uniform.

In all variants of the invention, the at least one turn which surrounds each auxiliary magnetic flux concentrator and/or the at least two induction coils have a substantially polygonal or rectangular or square or triangular or hexagonal or circular or elliptical shape or a combination thereof.

The dependent claims describe preferred embodiments of the invention.

BRIEF DESCRIPTION OF THE FIGURES

Further features and advantages of the present invention will be apparent in light of the detailed description of a preferred, but not exclusive, embodiment, of a transverse flux induction heating apparatus, illustrated by way of non-limitative example, with reference to the accompanying drawings, in which:

FIG. 8*a* is a further diagrammatic view of said second embodiment;

FIGS. 10*a*, 10*b* and 10*c* are section views taken along the planes A-A and B-B of three variants of the apparatus in FIG. 7;

The same reference numbers in the figures identify the same elements or components.

DETAILED DESCRIPTION OF PREFERRED EMBODIMENTS OF THE INVENTION

Figure 1:
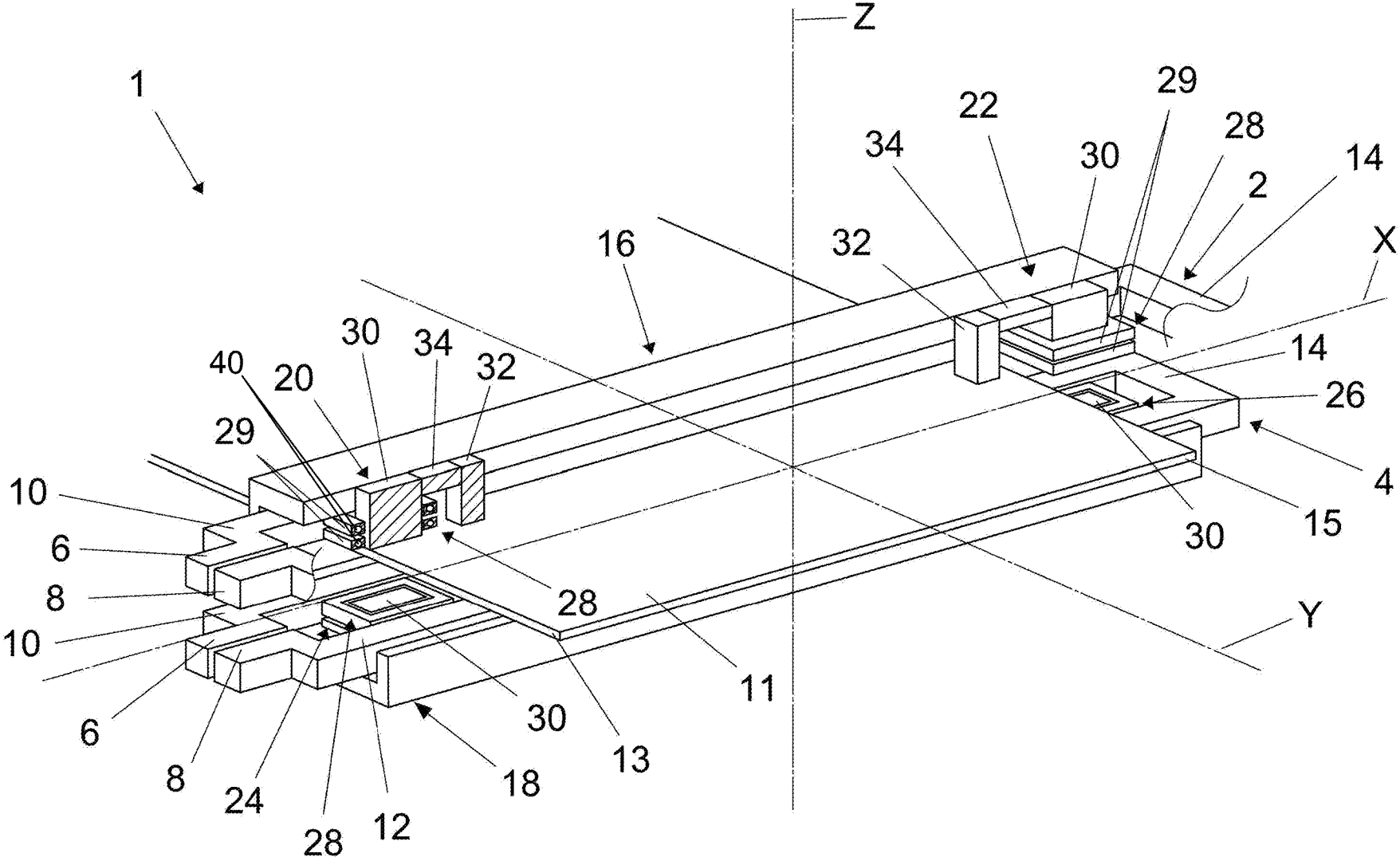
FIG. 1 is a partial perspective view of a first embodiment of an apparatus according to the invention.
Figure 2:
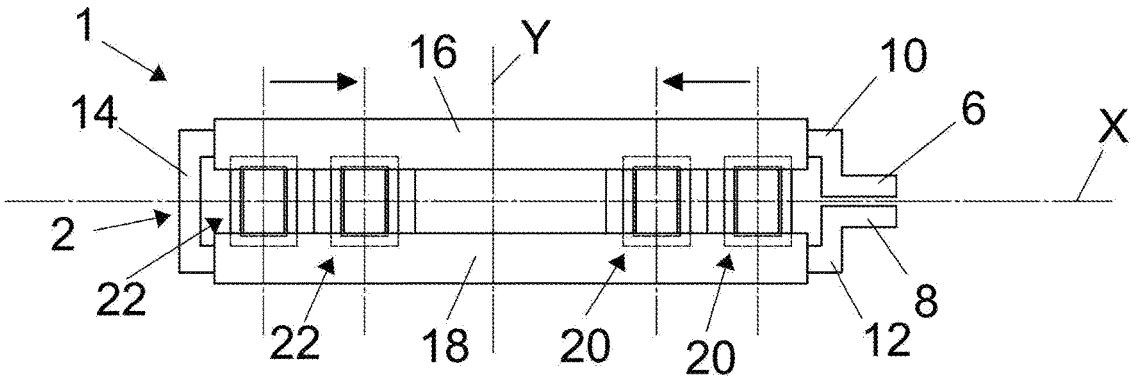
FIG. 2 is a diagrammatic top view of the apparatus in FIG. 1.
Figure 3:
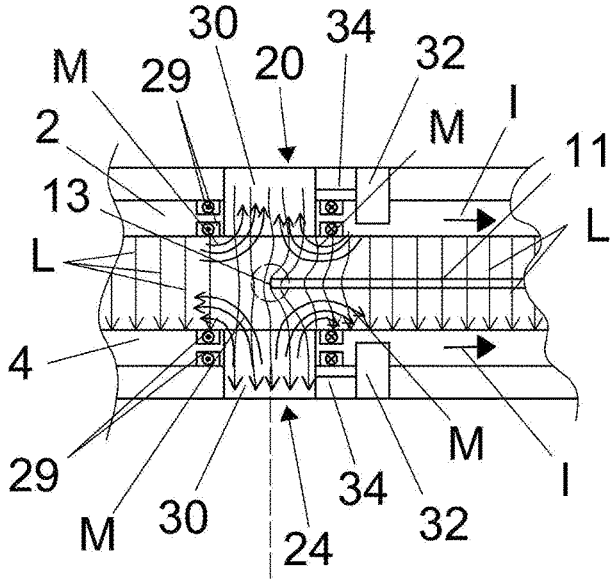
FIG. 3 diagrammatically shows the main magnetic field and the reaction magnetic field which are generated in the apparatus FIG. 1.

FIGS. 1 to 3 show a first embodiment of a transverse flux induction heating apparatus 1 for heating a metallic strip 11 according to the present invention.

The apparatus 1 comprises two identical induction coils 2, 4 arranged facing each other on mutually parallel planes, through which the strip 11 passes.

The two induction coils 2, 4 have a substantially rectangular shape. Alternatively, the induction coils may have another shape, e.g. polygonal or square or triangular or hexagonal or circular or elliptical shape or a combination thereof.

The apparatus 1 defines a triad of mutually perpendicular axes X, Y, Z. In particular, there are defined an axis X, which is parallel to the direction of maximum extension of the induction coils 2, 4; an axis Z, which is parallel to the direction according to which the induction coils 2, 4 are mutually distanced and an axis Y, which is parallel to the direction according to which the strip 11 moves during the passage between the induction coils 2, 4. Preferably, the turns 2, 4 are arranged totally over and totally under the space intended for the passage of the strip 11, respectively. In other words, each turn 2, 4 does not cross the plane, or the sheaf of parallel planes, intended for the passage of the strip 11. Each induction coil 2, 4 comprises a single conductor element, preferably provided with a cooling circuit (not shown).

Said conductor element has, for example, a square section, although other section shapes are possible, such as for example circular.

According to variants (not shown), each induction coil comprises several conductor elements arranged mutually side-by-side.

Preferably, the conductor element is of the copper type provided with a water cooling circuit.

The conductor element is appropriately folded. In particular, the conductor element is folded so as to comprise a portion which, when seen in top plan view, partially follows the profile of the perimeter of a rectangle and two connection portions 6, 8, mutually spaced apart and parallel, which are adapted to be connected to a source of alternating electric current.

More in detail, in each induction coil 2, 4 there are provided two greater sides 10, 12, mutually distanced apart according to the Y axis, which extend parallel to the axis X and are connected at their distal ends by the connection portions 6, 8, by a smaller side 14 which extends parallel to axis Y.

Each induction coil 2, 4 is provided with two main magnetic flux concentrators 16, 18. Preferably, each main magnetic flux concentrator 16, 18 partially surrounds the respective turn 2, 4 to address the magnetic field towards the strip 11. In particular, each main magnetic flux concentrator 16, 18 is arranged near the outer edges of a respective greater side 10, 12. Each main flux concentrator 16, 18 is substantially formed by an angular magnetic plate comprising a first stretch which extends parallel to the plane XY, and a second stretch which extends parallel to the plane XZ. The main flux concentrator 16, 18 has a smaller extension along the longitudinal axis X than the induction coil 2, 4 so as not to reach the smaller side 14 and the connection portions 6, 8. Said magnetic angular plate may be made of sintered powder, for example having a relative magnetic permeability comprised between 20 and 200, or of a Fe-Si sheet.

Advantageously, the apparatus 1 further comprises compensation poles, which are moveable with respect to the induction coils 2, 4, which are instead fixed, to reduce the heating at the edges of the strip and to compensate for the power gaps which, with the known solutions, are generated near said edges.

According to this first embodiment, the compensation poles are four and are arranged in the space which separates the two greater sides 10, 12 of each induction coil 2, 4. In particular, induction coil 2 is provided with two compensation poles 20, 22, and the other induction coil 4 is provided with two compensation poles 24, 26. The compensation poles 20, 22, 24, 26 are constrained to the respective induction coil 2, 4 so as to be able to slide with respect thereto. In particular, compensator poles 20, 22 are slidingly constrained to the greater sides 10, 12 of induction coil 2, while compensation poles 24, 26 are slidingly constrained to the greater sides 10, 12 of induction coil 4. In this manner, the compensation poles can slide parallel with respect to the longitudinal axis X.

Each compensation pole 20, 22, 24, 26 comprises a winding 28 made of conductor material, a first auxiliary magnetic flux concentrator 30 and a second auxiliary magnetic flux concentrator 32, mutually connected by means of a connection element 34. Preferably, the winding 28 is a distinct element from the corresponding turn 2, 4.

According to a variant (not shown), the compensation poles do not have the second auxiliary magnetic flux compensator 32 and the connection element 34.

The winding 28 comprises, by way of example, two concentric turns 29 superimposed with development parallel to the vertical axis Z, which define a space inside the winding 28. The number of turns 29 may also be either lower than or higher than two.

The turns 29 have a substantially rectangular shape. Alternatively, such turns may have another shape, e.g. polygonal or square or triangular or hexagonal or circular or elliptical or a combination thereof.

Preferably, the winding 28 is provided with a cooling circuit (partially shown). The cooling circuit comprises a pipe 40 (FIG. 1), arranged inside the turns 29, in which a cooling fluid flows. For example, the turns 29 of the winding 28 are made of copper and are provided with a water cooling circuit. By virtue of the cooling system, the turns 29 cool the auxiliary magnetic flux concentrator 30. By attracting the magnetic flux onto it so as to partially divert it from the edge of the strip 11, the auxiliary magnetic flux concentrator 30 tends to overheat and thus damage the components of the apparatus close to it, e.g. the insulators. Therefore, it is advantageous to be able to cool the auxiliary magnetic flux concentrator 30, and it is preferable to maintain its temperature constant over time to a value which is not excessively high.

According to the embodiment shown in FIGS. 1-3, the turns 29 of the winding 28 are short-circuited. According to an alternative variant, the winding 28 is adapted to be supplied by a source of alternating electric current, with frequency, for example, comprised between 100 Hz and 1 kHz, different from that for supplying the induction coils 2, 4. According to this alternative variant, the winding may be provided with further connection portions to such an alternating electric current source.

The winding 28 is preferably, but not necessarily, provided with four sides formed by turns 29 of preferably square or rectangular shape when seen in top plan view.

The turns 29 are slidingly constrained either to a greater side 10, 12 of the respective induction coil 2, 4, or to both said greater sides 10, 12. A first auxiliary magnetic flux concentrator 30, preferably provided as a block, e.g. parallelepiped-shaped, of appropriate magnetic or ferromagnetic material, is provided in the space defined by the winding 28, and fixed thereto. Preferably, each auxiliary magnetic flux concentrator 30 is a distinct element from the at least one turn 29 which surrounds it. Preferably, the first magnetic flux concentrator 30 is surrounded by the turns 29 only for part of its extension along the vertical axis Z.

Furthermore, each compensation pole 20, 22 is preferably arranged completely over the strip 11 and each compensation pole 24, 26 is arranged completely under the strip 11, when the latter passes between the induction coils 2, 4. In particular, all the compensation poles 20, 22, 24, 26 do not cross the plane, or sheaf of parallel planes, intended for the passage of the strip 11. The second auxiliary magnetic flux concentrator 32 is arranged externally with respect to the winding 28 and is positioned towards the inside of the apparatus 1, i.e. near the innermost side of the winding 28 with respect to axis Y (FIG. 1). Also the second auxiliary magnetic flux concentrator 32 is preferably provided as a block, e.g. parallelepiped-shaped, of appropriate magnetic material. Furthermore, preferably, the extension of the second magnetic flux concentrator 32 along the longitudinal axis X is smaller than that of the first magnetic flux concentrator 30 along the same direction, while the extension along the other directions Y, Z is approximately equal for the two magnetic flux concentrators 30, 32. Furthermore, the two magnetic flux concentrators 30, 32 are preferably substantially aligned along the longitudinal axis X.

The connection element 34 between the two magnetic flux concentrators 30, 32 may be made of either magnetic or non-magnetic material.

The invention and its advantages will be better understood by describing the operation of the apparatus according to the embodiment described above.

The induction coils 2, 4 are supplied by a source of alternating electric current, which, in a fixed instant of time has the direction shown by the arrows I (FIG. 3), generating a magnetic field, indicated by the arrows L which, in the considered instant, go from induction coil 2 to induction coil 4, so that induced currents are generated in the strip 11, which is heated by Joule effect when the strip 11 passes between the induction coils 2, 4.

According to the invention, the position of the compensation poles 20, 22, 24, 26 along the longitudinal axis X is predetermined as a function of the width of the strip 11. FIG. 2 shows, for example, two possible positions for the upper compensation poles 20, 22 which positions are selected as a function of the width of the strip. The width of the strip is the extension of the strip along the longitudinal axis X. The lower compensation poles 24, 26 underneath (not shown in FIG. 2) will occupy positions corresponding to those of the respective upper compensation poles 20, 22.

In particular, it is chosen to position the compensation poles 20, 24 so that they are at a first side edge 13 of the strip 11 (FIG. 3), parallel to axis Y when the strip 11 passes through the induction turns 2, 4. Similarly, it is chosen to position the compensation poles 22, 26 so that they are at the edge side edge 15 of the strip 11, opposite to the side edge 13. Therefore, the compensation poles 20, 24 are substantially mutually aligned and the compensation poles 22, 26 are substantially mutually aligned in directions parallel to the vertical axis Z.

The local heating of the edges can be modulated by varying the relative position of the compensation poles 20 and 24 along axis X, with respect to the side edges 13, 15 of the strip 11, advancing along axis Y.

An advantageous effect is given in that an induced current crosses the turns 29 of each winding 28 which in turn generates an induced magnetic field, or reaction magnetic field, indicated by the arrows M which bends near the turns 29. The reaction magnetic field M opposes the main magnetic field L at the edges 13, 15, thus producing a compensation effect. The compensation effect is particularly useful to avoid the problem of excessive heating of the edges 13, 15 of the strip. Typically, the entity of the compensation is proportional to the number of turns 29.

The auxiliary flux concentrators 30, 32, in general, reduce the undesired dispersions of the reaction magnetic field flux produced by the respective windings 28. In particular, the invention envisages that each flux concentrator 30 increases the local intensity of the reaction magnetic field produced by the induced current which crosses the turns 29. By virtue of the flux concentrator 30 it is also possible to reduce the number of turns 29, which promotes a greater localization of the reaction magnetic field. Thus, by appropriately positioning the compensation poles 20, 22, 24, 26, the power transferred locally at precise zones of the strip 11 is intensified. Considering the aforesaid problem of the "power gap", this is compensated by virtue of the intensification of the main magnetic field and the consequent intensification of the heating of specific zones of the strip 11, due to the presence of the first auxiliary magnetic flux concentrator 30 and promoted by the presence of the second auxiliary magnetic flux concentrator 32.

Figure 4:
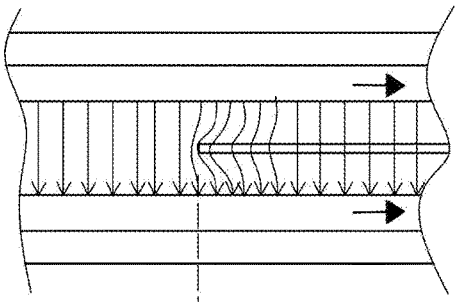
FIG. 4 diagrammatically shows the magnetic field which is generated in a known apparatus without compensation poles.
Figure 5:
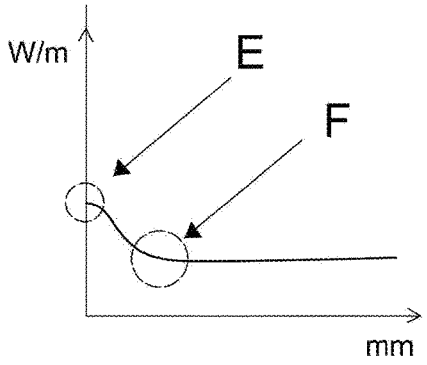
FIG. 5 shows the power density pattern, expressed in W/m, as a function of the width of the strip, expressed in meters, in the apparatus in FIG. 3.
Figure 6:
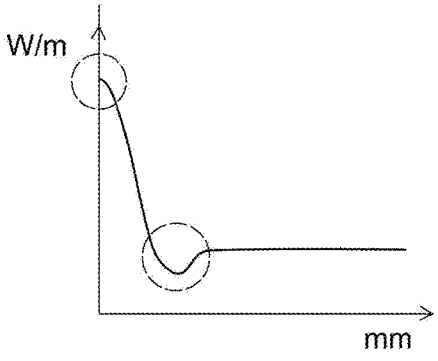
FIG. 6 shows the power density pattern, expressed in W/m, as a function of the width of the strip expressed in meters, in the apparatus in FIG. 4.

The advantages of the invention can be inferred from a comparison of FIGS. 3 and 5, related to the invention, with FIGS. 4 and 6, related to a solution without compensation poles.

FIG. 3 shows the pattern of the lines of the reaction magnetic field, produced by the turns 29, which opposes the main magnetic field at the edges 13, 15. It is worth noting the advantageous effect according to which the main magnetic field at the edges 13, 15 thin out to obtain a controlled heating of the edges 13, 15 of the strip. Such an effect is mainly due to the presence of the windings 28 and is promoted by the first flux concentrator 30.

Furthermore, in the zones of the strip 11 proximal to the edges 13, 15, there is an intensification of the main magnetic field, due to the presence of the second magnetic flux concentrator 32, also promoted by the presence of the first flux concentrator 30, so that there is a compensation of the disadvantageous "power gap" effect. By virtue of such a compensation, a generally more uniform heating of the strip 11 is obtained. Such results are shown in FIG. 5, which shows the power pattern as a function of the width of the strip, starting from an edge 13, at which a considerable reduction of the power, highlighted by the dashed circle E, is obtained. It is also worth noting that there is a compensation of the "power gap", highlighted by the dashed circle F, in a zone proximal to the edge 13. Conversely, in the configuration without compensator poles shown in FIG. 4, which is not part of the invention, there is a greater, undesired heating at the edges of the strip and a drastic and undesired decrease of the heating in the zones proximal to such edges, and as can be observed in the power pattern as a function of the width of the strip shown in FIG. 6.

Furthermore, since the compensation poles 20, 22, 24, 26, can be moved along the longitudinal axis X, the aforesaid advantageous effects can be obtained, for strips of different width, simply by appropriately moving the compensation coils 20, 22, 24, 26. In general, the intensity of the compensation can also be modulated according to the position of the compensation poles 20, 22, 24, 26.

In the variant in which the windings 28 are supplied by a source of electric current, the sense of such a current must be adapted to create a reaction magnetic field which locally opposes the main magnetic field. The compensation is typically proportional to the intensity of the current set on the winding.

FIGS. 7 to 12 show a second embodiment of a transverse flux induction heating apparatus 100 for heating a metallic strip 11 according to the present invention. The apparatus 100 comprises two induction coils 102, 104 arranged facing each other on planes mutually parallel through which the strip 11, or plate, to be heated passes.

The two induction coils 102, 104 have a substantially rectangular shape. Alternatively, the induction coils may have another shape, e.g. polygonal or square or triangular or hexagonal or circular or elliptical or a combination thereof.

The apparatus 100 defines a triad of mutually perpendicular axes R, S, T. In particular, there are defined an axis R, which is parallel to the direction of maximum extension of the induction coils 102, 104; an axis T, which is parallel to the direction according to which the induction coils 102, 104 are mutually distanced and an axis S which is parallel to the direction according to which the strip 11 moves during its passage between the induction coils 102, 104. Preferably, the turns 102, 104 are arranged totally over and totally under the space intended for the passage of the strip 11, respectively. In other words, each turn 102, 104 does not cross the plane, or sheaf of parallel planes, intended for the passage of the strip 11.

Figure 8A:
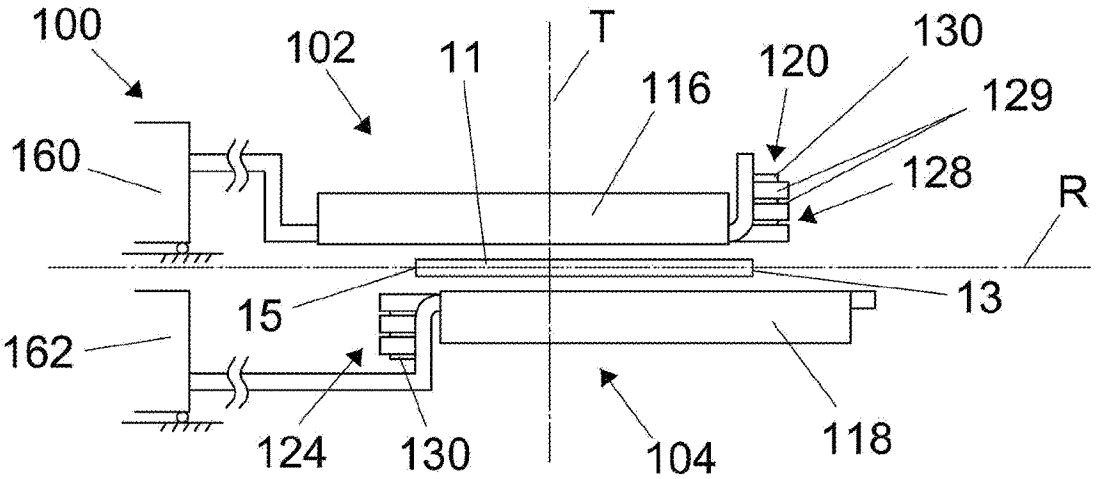
FIG. 8*a* is a diagrammatic view of said second embodiment.
Figure 8B:
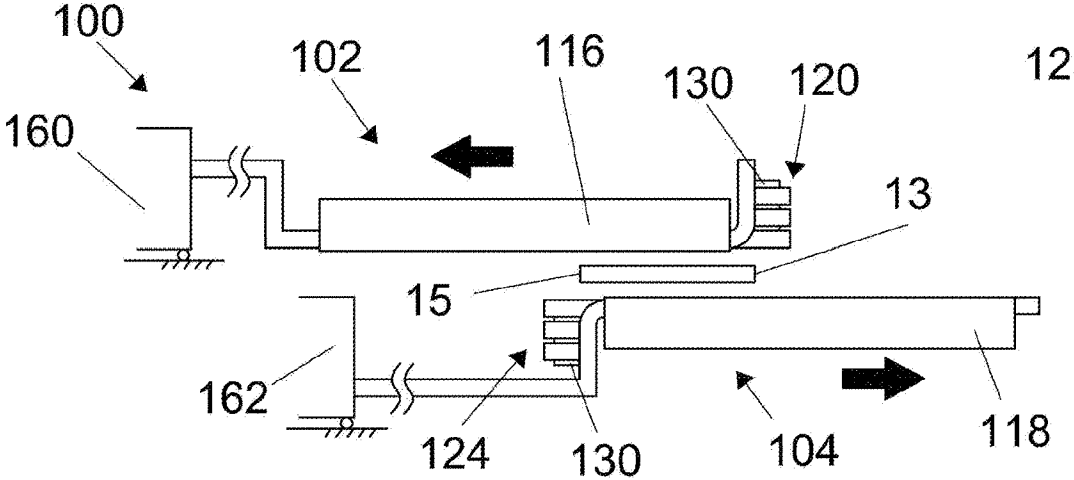
Figure 9:
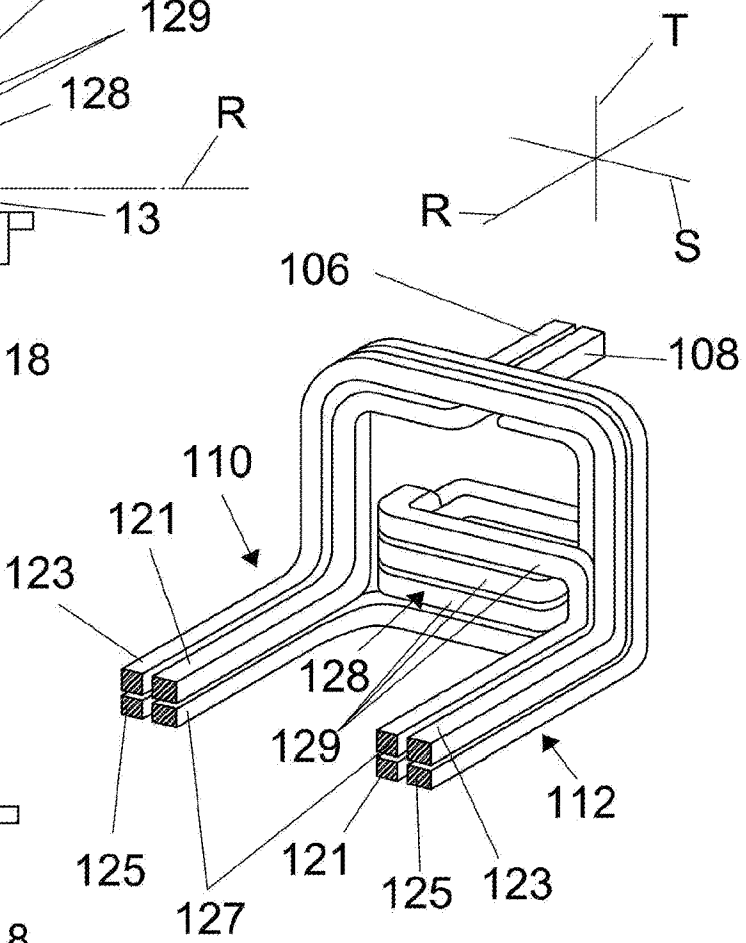
FIG. 9 is a perspective view of part of a component of the apparatus in FIG. 7.

The induction coils 102, 104 are constrained to a respective carriage 160, 162, so as to be sliding along the longitudinal axis R (FIGS. 8*a*, 8*b*). Preferably, the two carriages 160, 162 are arranged on one same side with respect to the plane TS, preferably on the supply side of the induction coil.

In a preferred variant each induction coil 102, 104 comprises four conductor elements 121, 123, 125, 127, which are arranged side-by-side for some stretches. According to variants (not shown) the number of conductor elements may be different from four. Preferably, the conductor elements 121, 123, 125, 127 are provided with a cooling circuit (partially shown). The cooling circuit comprises, inside the conductor elements 121, 123, 125, 127, a respective pipe 140 (FIG. 10 *a,b,c*) in which a cooling fluid flows. Preferably, the conductor elements 121, 123, 125, 127 are of the type made of copper provided with a water cooling circuit. The conductor elements 121, 123, 125, 127, for example, have a square section but other section shapes, such as for example circular, are possible.

The conductor elements 121, 123, 125, 127 of each induction coil 102, 104 are appropriately folded.

Advantageously, part of the conductor element 127 is folded so as to form a winding 128 of concentric and superimposed turns 129. By way of example, there may be three turns 129. The winding 128 is preferably, but not necessarily provided with four sides, with the turns 129 of either square or rectangular shape when seen in top plan view. Alternatively, such turns may have another shape, e.g. polygonal or triangular or hexagonal or circular or elliptical or a combination thereof.

An auxiliary magnetic flux concentrator 130, preferably provided as a block, e.g. parallelepiped-shaped, of appropriate magnetic or ferromagnetic material, is provided in the space defined by the winding 128, and fixed thereto. Preferably, each auxiliary magnetic flux concentrator 130 is a distinct element from the at least one turn 129 which surrounds it. Preferably, the magnetic flux concentrator 130 is surrounded by the turns 129 only for part of its extension along the vertical axis T.

When provided with a cooling system, the turns 129 cool the auxiliary magnetic flux concentrator 130. The advantages previously described for the first embodiment are thus obtained.

The winding 128 and the auxiliary magnetic flux concentrator 130 form a compensation pole 120, 124 (FIGS. 8*a*, 8*b*), also named active compensation pole being supplied directly by current.

Thus, the apparatus 100 comprises two compensation poles 120, 124, one for each induction coil 102, 104, which are moveable along the longitudinal axis 102, 104 being integrally fixed to the latter.

Furthermore, preferably, compensation pole 120 is arranged completely over the strip 11 and compensation pole 124 is arranged completely under the strip 11, when the latter passes between the induction coils 102, 104. In particular, both the compensation poles 120, 124 do not cross the plane, or sheaf of parallel planes, intended for the passage of the strip 11. The shape of the induction coils 102, 104 will be described with reference to the enlarged detail shown in FIG. 9, which is referred, for example, to the induction coil 104.

The conductor elements 121, 123, 125, 127 are folded so as to comprise two parallel stretches 110, 112, which extend along the longitudinal axis R and are distanced apart according to the transverse axis S, in which the four conductor elements 121, 123, 125, 127 are arranged side-by-side. The stretches 110, 112 are fixed to the carriage 162. After the two stretches 110, 112, the conductor element 127 continues winding onto itself, thus forming the turns 129 which by superimposing form the winding 128 which develops parallel to the vertical axis T. After each of the two stretches 110, 112, the conductor element 121 continues with a stretch parallel to the vertical axis T, then with a stretch parallel to the transverse axis S and then with a stretch parallel to the longitudinal axis R, so as to have two connection portions 106, 108 mutually parallel and facing, adapted to be connected to an alternating electric current source. The connection portions 106, 108 extend on a side opposite to the extension side of the stretches 110, 112. After each of the two stretches 110, 112, the conductor elements 123, 125 first continue with a stretch parallel to the vertical axis T and then with a joining stretch, which is parallel to the transverse axis S.

In the specific configuration shown, each induction coil 102, 104 is provided with a respective main magnetic flux concentrator 116, 118. Preferably, each main magnetic flux concentrator 116, 118 partially surrounds the respective turn 102, 104 to address the magnetic field towards the strip 11.

The main flux concentrator 116, 118 may have, for example, different configurations shown in FIGS. 10*a*, 10*b* and 10*c*.

Each main flux concentrators 116, 118 comprises at least one flat surface parallel to the plane RS and at least one flat surface parallel to the plane RT. Furthermore, each main flux concentrator comprises an end portion 132, external to the winding 128, and being proximal and aligned, according to axis R, to the auxiliary flux concentrator 130.

In the first variant in FIG. 10*a*, the longitudinal body, extending along axis R, of the main flux concentrator 116, which ends on one side with the end portion 132, is formed by two substantially L-shaped angular plates 50 mutually separated by a space, which cover the outer edges of the induction coil 102 with reference to the apparatus seen as a whole. The angular plates 50 comprise a first stretch which extends parallel to the plane RT, and a second stretch which extends parallel to the plane RS.

Figure 7:
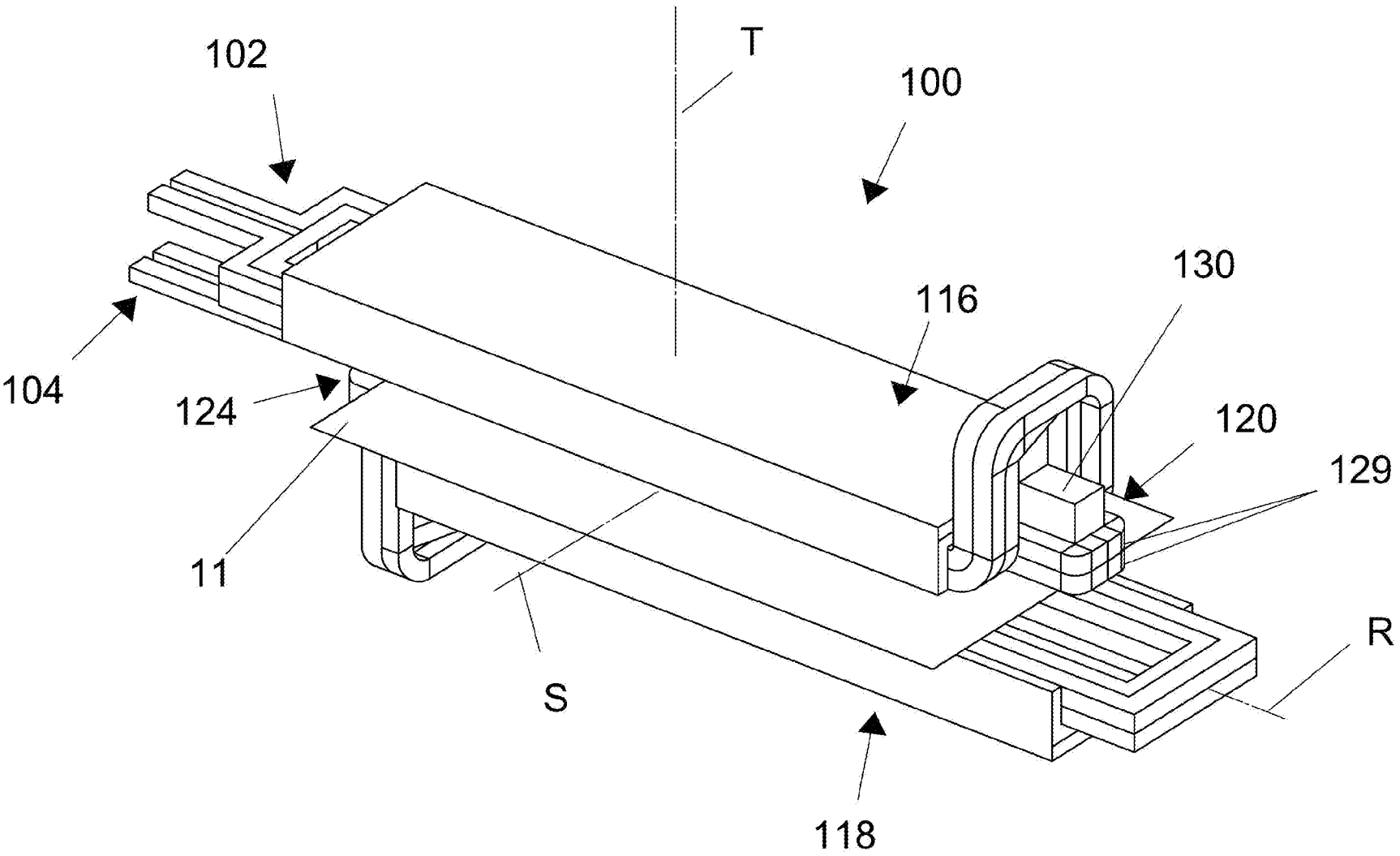
FIG. 7 is a perspective view of a second embodiment of an apparatus according to the invention.

In the second variant of FIG. 10*b*, the longitudinal body, extending along axis R, of the main flux concentrator 116, which ends on one side with the end portion 132, is formed by a single substantially C-shaped plate 51, which covers the outer edges of the induction coil 102 with reference to the apparatus seen as a whole (also see FIG. 7). The two C-shaped arms extend parallel to the plane RT, while the C-shaped central body extends parallel to the plane RS.

In the third variant of FIG. 10*c*, the longitudinal body, extending along axis R, of the main flux concentrator 116, which ends on one side with the end portion 132, is formed by a single flat plate 52, parallel to the plane RS which covers only the upper outer edges of the induction coil 102 with reference to the apparatus seen as a whole.

In all variants, the main flux concentrator 118 of the lower induction coil 104 is identical to the main flux concentrator 116 but is arranged upside-down with respect to it.

The extension of the main flux concentrators 116, 118 along the longitudinal axis R is smaller than the extension of the induction coils 102, 104 so that the ends of the latter are external to the respective concentrator 116, 118. Said main flux concentrators 116, 118 may be made of sintered powder having, for example, a relative magnetic permeability comprised between 20 and 200, or by Fe—Si plate.

The invention and its advantages will be better understood by means of the description of operation of the apparatus according to this second embodiment described above.

Figures 11, 12:
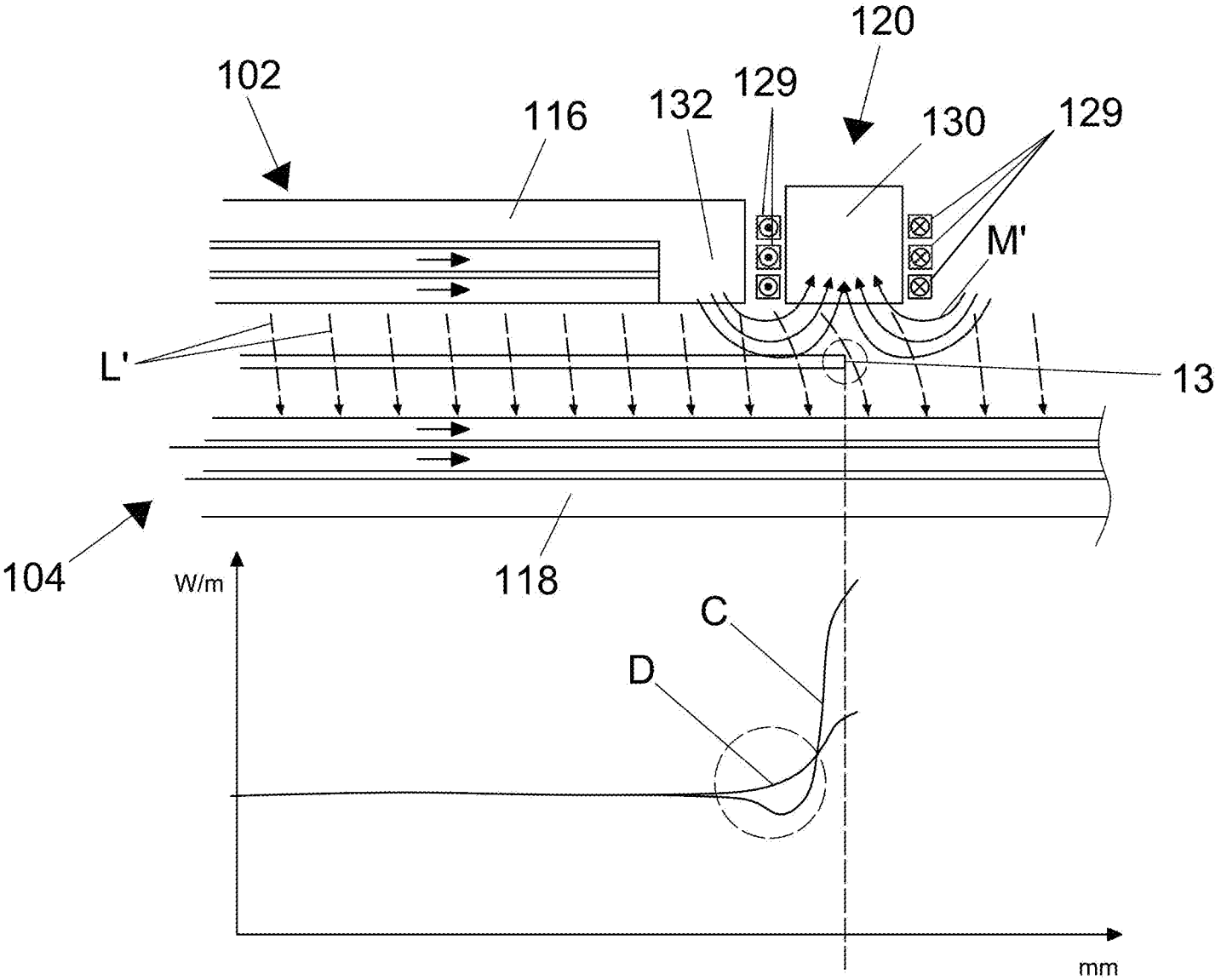
FIG. 11 diagrammatically shows the main magnetic field and the reaction magnetic field which are generated in the apparatus FIG. 7.
FIG. 12 shows a comparison between the power density pattern as a function of the width of the strip of the apparatus in FIG. 7 and the corresponding pattern of a known apparatus without compensation poles.

The induction coils 102, 104 are supplied by an alternating electric current source generating a magnetic field, indicated in FIG. 11 by the arrows L', which go from the induction coil 102 to the induction coil 104, so that induced currents are generated in the strip which is heated by Joule effect when the strip 11 passes between the induction coils 102, 104. According to the invention, the position of the compensation poles 120, 124 along the longitudinal axis R is predetermined as a function of the width of the strip 11. FIGS. 8*a* and 8*b* show two possible example positions of the induction coils 102, 104, and thus of the compensation poles 120, 124, which are selected according to the width of the strip, respectively. The width of the strip is the extension along the longitudinal axis R. In particular, it is chosen to position the compensation poles 120, 124 so that when the strip 11 passes through the induction coils 102, 104, the compensation pole 120 is at a first side edge 13 of the strip 11 and the compensation pole 124 is at the second side edge 15 of the strip 11.

By varying the position of the induction coils 102 and 104 along axis R, it is possible to arrange the compensation poles 120 and 124 so as to modulate the local heating of the respective edges 13 and 15 of the strip 11, advancing in direction S. For example, the more the carriage 160 is moved leftwards, the greater is the compensation effect on the heating of the edge 13 of the strip.

Advantageously, the current which crosses the other conductor elements 121, 123, 125 is the same as that which crosses the turns 129 of each winding 128, being all said elements connected in series. An advantageous effect is in that the current which crosses the turns 129 generates an induced magnetic field, or reaction magnetic field, indicated by the curved arrows M' near the turns 129 (FIG. 11).

The reaction magnetic field opposes the main magnetic field at the edges 13, 15, thus producing a compensation effect. The compensation effect is particularly useful to avoid the problem of excessive heating of the edges 13, 15 of the strip described above. Typically, the entity of the compensation is proportional to the number of turns 129 and to the current crossing them.

In general, the auxiliary flux concentrators 130 reduce the undesired dispersions of the magnetic field flux produced by the respective windings 128. In particular, the invention provides that each flux concentrator 130 increases the local intensity in specific zones of the reaction magnetic field produced by the current which crosses the turns 129. By virtue of the flux concentrator 130, it is also possible to reduce the number of turns 129, which promotes a greater localization of the reaction magnetic field.

Figure 10:
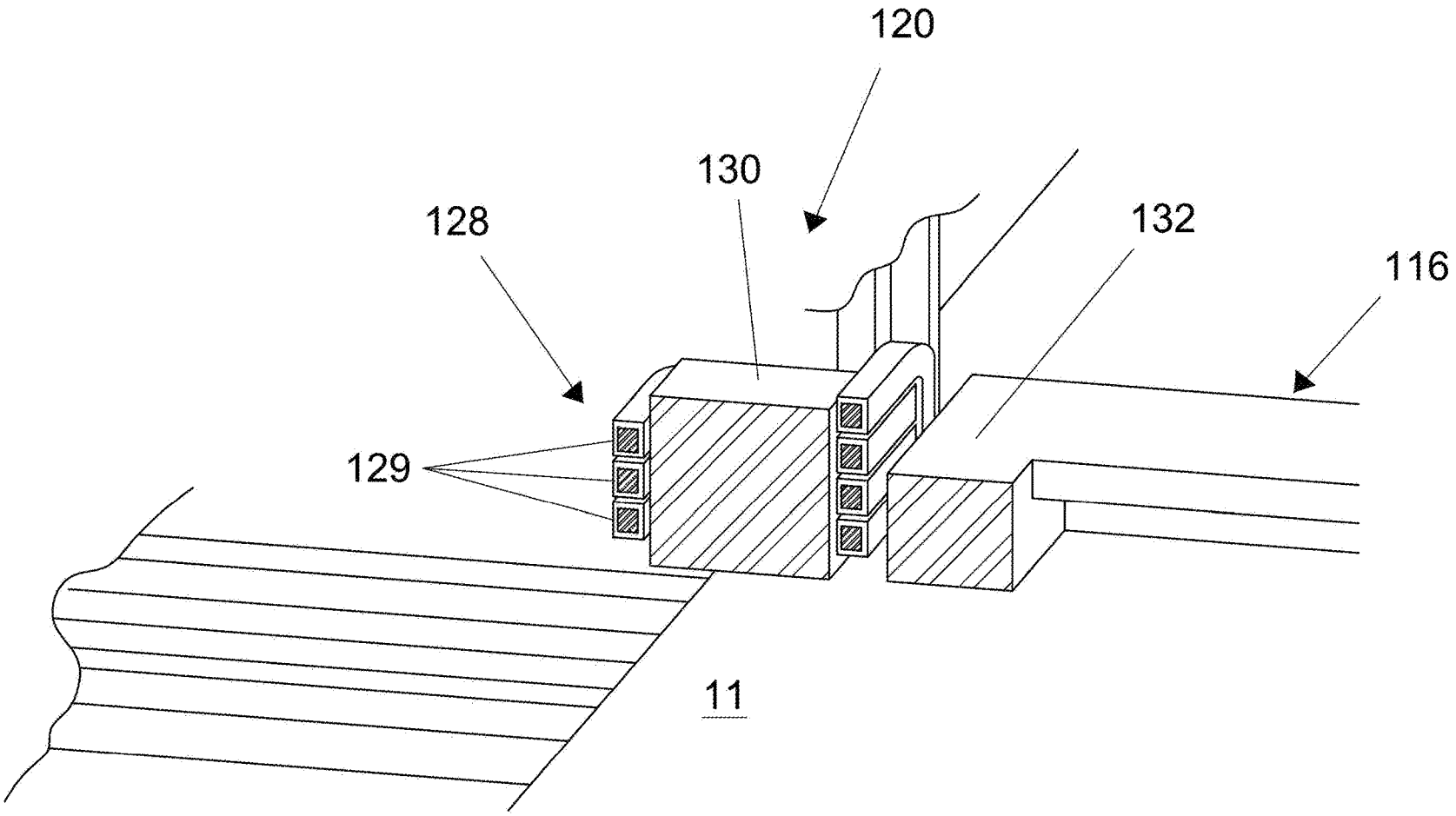
FIG. 10 is a partially sectioned perspective view of the apparatus in FIG. 7.

Another advantageous effect is that the power transferred locally to the specific zones of the strip 11 is intensified by appropriately positioning the compensation poles 120, 124. Considering the aforesaid problem of the "power gap", this is compensated by virtue of the intensification of the main magnetic field and the consequent intensification of the heating of specific zones of the strip 11, due to the presence of the end portion 132 of the main magnetic flux concentrator 116. The intensification is also promoted by the presence of the auxiliary flux concentrator 130 (FIGS. 10, 11).

FIG. 11 shows the pattern of the lines of the reaction magnetic field produced by the turns 129, which opposes the main magnetic field at the edges 13, 15. It is worth noting the advantageous effect according to which the main magnetic field at the edges 13, 15 thin out to obtain a controlled heating of the edges 13, 15 of the strip. Such an effect is mainly due to the presence of the windings 128 and is promoted by the auxiliary magnetic flux concentrator 130.

Furthermore, in the zones of the strip 11 proximal to the edges 13, 15, there is an intensification of the main magnetic field due to the presence of the end portion 132 of the main magnetic field concentrator 116 which increases the main magnetic flux also promoted by the presence of the auxiliary magnetic flux concentrator 130, so that there is a compensation of the disadvantageous "power gap" effect. By virtue of such a compensation, a generally more uniform heating of the strip 11 is obtained.

Such results are shown in FIG. 12, which shows the power pattern as a function of the width of the strip which can be obtained with the apparatus 100 of the invention, curve D, and with an apparatus not provided with the compensator poles, curve C. It is worth noting that the power at the edge 13 is considerably lower using the solution of the invention. It is also worth noting that the zone proximal to the edge of the strip in which there is the compensation of the "power gap", shown by the dashed circle.

Instead, in curve C related to the configuration without compensation poles, which does not belong to the invention, it is worth noting a greater and undesired heating at the edges of the strip and a drastic and undesired decrease of the heating in the zones proximal to such edges.

Furthermore, since the compensator poles 120, 124 are moveable along axis R, the aforesaid advantageous effects can be obtained for strips of different width.

In particular, the induction coils 102, 104 can be moved so that the concatenated flux is variable as a function of the width of the strip. The fact that the compensation coil, in particular the winding 128, is supplied with the same current that crosses the respective induction coil makes the compensation effect automatically modulated according to the heating power. A further degree of freedom for modulating the intensity of the compensation is determined by the position of the compensation pole with respect to the rest of the strip. It is worth noting that the winding described for the first embodiment which is not supplied by electrical current and which can be supplied by a current source different from the main source can be used also in the second embodiment. Furthermore, although in the described embodiments all the compensation poles are adapted to move, the invention also provides that only part of the compensation poles can move. For example, in a variant of the first embodiment, it is provided that only one compensation pole for each induction coil can move, so that the compensation coils of different induction coils can be aligned along a direction parallel to the vertical axis Z. One variant of the second embodiment of the invention provides that only one of the two induction coils is adapted to move. The invention also provides a heating oven in which a series of apparatuses according to the first and/or second embodiment are arranged in sequence along axis Y.

The invention claimed is:

1. A transverse flux induction heating apparatus, defining a first longitudinal axis, for heating a metallic strip, the apparatus comprising:

at least two induction coils arranged on respective planes parallel to each other and parallel to said first longitudinal axis, and mutually arranged at a distance such to allow a passage of the metallic strip between said at least two induction coils along a second longitudinal axis perpendicular to said first longitudinal axis, at least one main magnetic flux concentrator arranged about each induction coil;

at least two compensation poles, each compensation pole being constrained to a respective induction coil, wherein each compensation pole comprises:

a winding having at least, one turn, a first auxiliary magnetic flux concentrator surrounded by the at least one turn of the winding, wherein at least one of said at least two compensation poles is adapted to move along a direction parallel to the first longitudinal axis.

2. The apparatus according to claim 1, wherein the first auxiliary magnetic flux concentrator is a distinct element from the at least one turn.

3. The apparatus according to claim 1, wherein the at least two induction coils are arranged totally over and totally under a space intended for the passage of the metallic strip, respectively.

4. The apparatus according to claim 1, wherein the at least two compensation poles are arranged totally over and totally under a space intended for the passage of the metallic strip, respectively.

5. The apparatus according to claim 1, wherein each induction coil is fixed and provided with two compensation poles, and at least one compensation pole of said two compensation poles is slidingly fixed to said induction coil, so as to be adapted to move along a direction parallel to said first longitudinal axis.

6. The apparatus according to claim 5, wherein both compensation poles of each induction coil are slidingly fixed thereto, so as to be adapted to move, along a direction parallel to said first longitudinal axis.

7. The apparatus according to claim 5, wherein a second auxiliary magnetic flux concentrator is associated to each first auxiliary magnetic flux concentrator, said second auxiliary magnetic flux concentrator being arranged externally to the at least one turn and in an innermore position, with reference to the second longitudinal axis, with respect to the corresponding first auxiliary magnetic flux concentrator.

8. The apparatus according to claim 1, wherein said at least two compensation poles are integrally fixed to a respective induction coil and wherein at least one induction coil of said at least two induction coils is adapted to move along a direction parallel to said first longitudinal axis.

9. The apparatus according to claim 8, wherein said at least two induction coils are adapted to translate along a direction parallel to said first longitudinal axis.

10. The apparatus according to claim 8, wherein the winding of each compensation pole of each induction coil is an integral part of a respective induction coil.

11. The apparatus according to claim 1, wherein the first auxiliary magnetic flux concentrator is made of magnetic or ferromagnetic material.

12. The apparatus according to claim 1, wherein each winding comprises at least two turns.

13. The apparatus according to claim 1, wherein said winding is adapted to be fed by a source of alternating electric current.

14. The apparatus according to claim 1, wherein said at least one turn of the winding is provided therein with at least one pipe for a cooling fluid.

15. The apparatus according to claim 1, wherein said at least one turn and/or said at least two induction coils have a substantially polygonal or rectangular or square or triangular or hexagonal or circular or elliptical shape or a combination thereof.

* * * * *